US005175992A

United States Patent [19]

Stahlecker

[11] Patent Number: 5,175,992

[45] Date of Patent: Jan. 5, 1993

[54] METHOD FOR PREVENTING THE INOPERATABILITY OF AN OPEN-END SPINNING ROTOR

[75] Inventor: Fritz Stahlecker, Bad Überkingen, Fed. Rep. of Germany

[73] Assignee: Hans Stahlecker, Fed. Rep. of Germany; a part interest

[21] Appl. No.: 662,704

[22] Filed: Mar. 1, 1991

[30] Foreign Application Priority Data

Mar. 9, 1990 [DE] Fed. Rep. of Germany ..... 4007494

[51] Int. Cl.[5] ..... D01H 13/00; D01H 4/00

[52] U.S. Cl. ..... 57/406; 29/898.01; 57/105; 384/616

[58] Field of Search ..... 57/104-105, 57/408; 29/898.01; 384/610, 616

[56] References Cited

U.S. PATENT DOCUMENTS

| | | | |
|---|---|---|---|
| 867,426 | 10/1907 | Shields | 384/610 X |
| 1,469,424 | 10/1923 | McQuaid et al. | 384/610 |
| 3,822,541 | 7/1974 | Croasdale et al. | 57/416 |
| 3,845,612 | 11/1974 | Chisholm et al. | 57/416 X |
| 3,875,732 | 4/1975 | Ellingham | 57/406 |
| 3,903,683 | 9/1975 | Shino | 57/416 X |
| 4,205,423 | 6/1980 | Poole et al. | 57/129 X |
| 4,319,449 | 3/1982 | Hofmann | 57/404 |
| 4,763,469 | 8/1988 | Stahlecker et al. | 57/406 X |
| 4,916,891 | 4/1990 | Landwehrkamp et al. | 57/104 X |

FOREIGN PATENT DOCUMENTS

| | | |
|---|---|---|
| 2716573 | 10/1978 | Fed. Rep. of Germany . |
| 3835037 | 4/1990 | Fed. Rep. of Germany ..... 57/416 |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

A method and apparatus for preventing that an open-end spinning rotor becomes inoperative. In an open-end spinning rotor assembly which has a rotor with a fiber collecting groove and a rotor shaft, it is provided that the operability of the open-end spinning rotor after the wearing-out of the rotor shaft in the are of the step bearing surface is restored by the fact that the distance between the fiber collecting groove and the step bearing surface is restored to its predetermined value by the axial shifting of the shaft in the hub of the rotor plate.

12 Claims, 2 Drawing Sheets

1
2
3
23
32
33
34
35
36
37
38
39
40
b
c
e
a
Y
X
b1
a1
d
b2
e1

METHOD FOR PREVENTING THE INOPERATABILITY OF AN OPEN-END SPINNING ROTOR

BACKGROUND AND SUMMARY OF THE INVENTION

The invention relates to a method for preventing the inoperability of an open-end spinning rotor arrangement, which has a rotor with a fiber collecting groove. A hub is provided into which a rotor shaft is pressed. The free end of the rotor shaft has a step bearing surface which is arranged at a predetermined distance from the fiber collecting groove.

It is known from German Patent Document DE-A 27 16 573 to radially support the spinning rotor assemblies, which are formed by a rotor and a rotor shaft, by means of a supporting disk bearing assembly for the rotor shaft. The rotor shafts are supported in the axial direction by means of a step bearing which contains a ball excited to perform vibrations on which the free end of the shaft is supported by means of a step bearing surface. Previously, spinning rotors of this type became unusable after extensive usage because the rotor was worn out particularly in the area of the fiber collecting groove. However, recently, this wearing of the rotors has been significantly reduced by the fact that the rotors were made of steel and, in the area of the interior of the spinning rotor, were subjected to a special treatment and were provided with an additional coating. It was found in practice that these open-end spinning rotors now become unusable in a different manner, specifically that a wearing takes place in the area of the step bearing surfaces of the rotor shafts. This wearing which may differ considerably at the individual spinning points, has the result that the rotor changes its position in the axial direction so that then the adjusted distances to a fiber feeding duct and particularly to a yarn withdrawal nozzle, which influence the spinning result, will also change. Although it is known from German Patent Document DE-A 27 16 573 to equip the end of the rotor shaft with an exchangeable projection which has a step bearing surface, the exchange of this projection in order to prevent a wearing-out requires high technical expenditures, is expensive and, under certain circumstances, may also have the result that the concentricity of the open-end spinning rotor may change and it must then be balanced again.

It is an object of the invention to provide a method for preventing the wearing-out of an open-end spinning rotor which is simple and can be carried out without major expenditures.

This object is achieved according to the invention in that the operability of the open-end spinning rotor is restored after a wearing-out of the step bearing surface by means of an axial shifting of the shaft in the hub of the rotor so that the distance between the fiber collecting groove and the step bearing surface is restored to a predetermined value.

By means of the method and apparatus according to the invention, it is possible to restore the operability of the open-end spinning rotor in a simple manner without the risk of ovalization. Practice has shown that the hub length and thus the length of the press fit, as a rule, is overdimensioned so that a slight axial shifting of the rotor shaft, as it is required for compensating the wear, does not reduce the tightness of the press fit.

In order to permit a repeated restoring of the operability of the rotor assembly, it is provided in a further development of the invention that, in the case of a rotor shaft that is still new, the front end of the rotor shaft facing away from the step bearing surface projects over the hub in the axial direction toward the interior of the rotor.

Other objects, advantages and novel features of the present invention will become apparent from the following detailed description of the invention when considered in conjunction with the accompanying drawings.

DETAILED DESCRIPTION OF THE DRAWINGS

Figure 1:
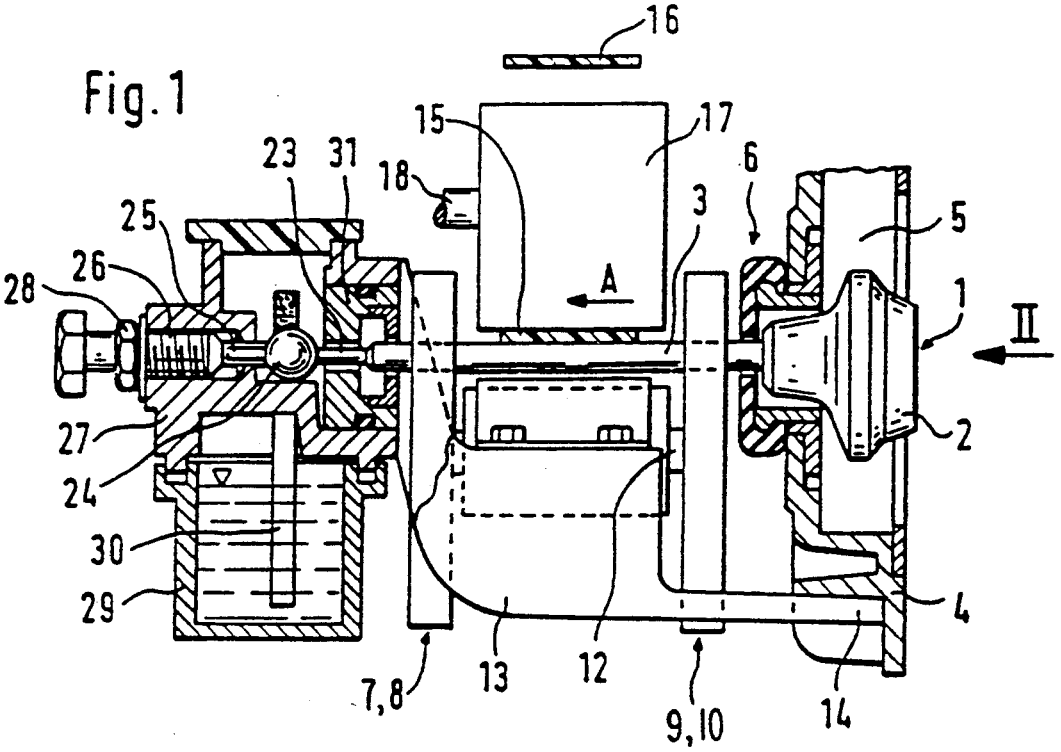
FIG. 1 is a partially sectional axial view of a bearing assembly for an open-end spinning rotor constructed according to the invention.

FIG. 1 illustrates an open-end spinning rotor 1 with its bearing assembly. The open-end spinning rotor assembly 1 has a rotor 2 and a rotor shaft 3. The rotor 2 is arranged in a rotor housing 4 which is connected to a vacuum source, which is not shown, and forms a vacuum chamber 5 surrounding the rotor plate 2. The rotor housing 4 is provided with a ram air seal 6 which is penetrated by the rotor shaft 3.

Figures 3, 4, 5:
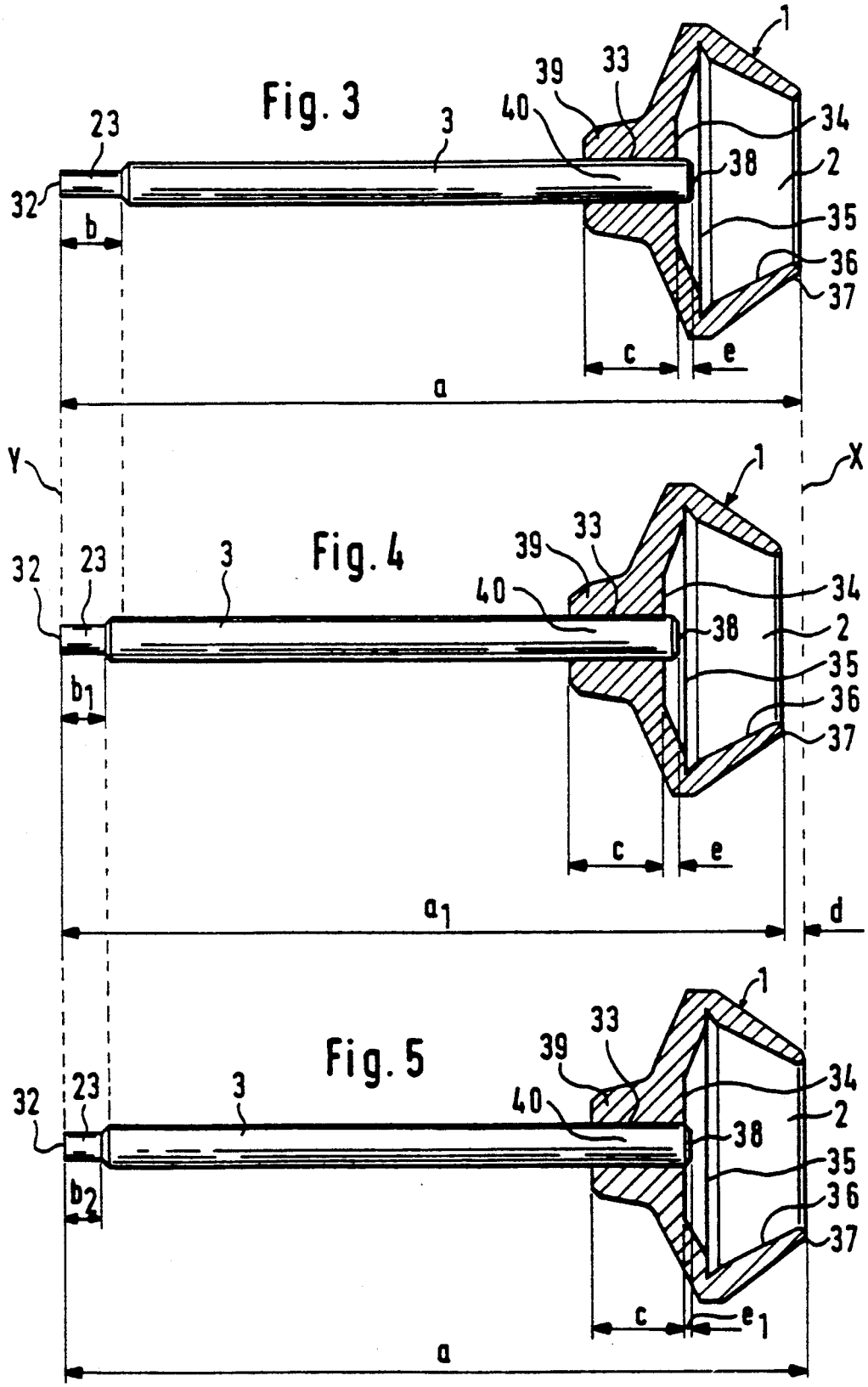
FIG. 3 is an axial sectional view of an open-end spinning rotor in the new condition.
FIG. 4 is an axial sectional view of a spinning rotor after a wearing-off in the area of the step bearing surface.
FIG. 5 is an axial sectional view of the spinning rotor according to FIG. 4 after its operability was restored.

The rotor shaft 3 is radially disposed in a supporting disk bearing which is formed by two pairs of supporting disks 7, 8, the supporting disks 9, 10 of which forming a wedge-shaped gap 11 in which the rotor shaft 3 is disposed (FIG. 3). The supporting disks 9, 10 of the pairs of supporting disks 7, 8 are each arranged on shafts 12 whose bearings are held in a bearing housing 13. The bearing housing 13 is provided with a projection 14 on which the rotor housing 4 is supported.

The drive of the open-end spinning rotor assembly 1 takes place by way of the lower end 15 of a tangential belt which moves along in contact with the rotor shaft 3 between the pairs of supporting disks 7, 8, and drives the rotor shaft 3 and, at the same time, holds it in the wedge-shaped gaps 11 of the pairs of supporting disks 7, 8. The returning end 16 of the tangential belt, which travels through in the longitudinal direction of the machine and drives the open-end spinning rotors of the spinning points of one side of the machine, is guided back above the open-end rotor shafts 3.

In the direct proximity of the rotor shafts 3, the lower end 15 of the tangential belt is loaded in each case by means of a pressure roller 17 in the direction of the rotor shafts 3. The pressure roller 17 is disposed on a shaft 18 which is in parallel to the rotor shaft 3 and is held by a holder 19 which can be swivelled around a swivelling axis 20 which is in parallel to the shaft 18. The holder 19 is loaded by means of a leaf spring 21 which is fastened to a machine part 22.

The shafts 12 of the supporting disks 9, 10 of the pairs of supporting disks 7, 8 are skewed around a shaft, which extends in parallel to the travelling direction of the lower end 15 of the tangential belt, in such a manner that an axial thrust in the direction of the arrow (A) is exercised on the rotor shaft 3 which is directed from the rotor 2 to a step bearing by mean of which the open-end spinning rotor is positioned axially. The rotor shaft 3 has an end 23, which is reduced in its diameter and is supported on a ball 24 by means of a step bearing surface. The ball 24 is held by an abutment 25 which is arranged on the opposite side of the ball 24 and located as an axial extension of the rotor shaft 3. The abutment 25 has a threaded part 26 by means of which it is screwed into a thread of a step bearing housing 27. The adjustable abutment 25 is secured by means of a check nut 28. The step bearing housing 27 is carried by a projection of the bearing holder 13. A container 29, which forms a lubricant chamber, is mounted on the step bearing housing 27. A ring-shaped wick 30 projects into this lubricant chamber, rests on the ball 24 from above and, in this manner, supplies it with the lubricant. The step bearing housing 27 is sealed off toward the outside by means of a seal 31 which, together with the rotor shaft 3, forms sealing gaps in the area of the end 23 and of the area which is situated in front of it and has a larger diameter.

Figure 2:
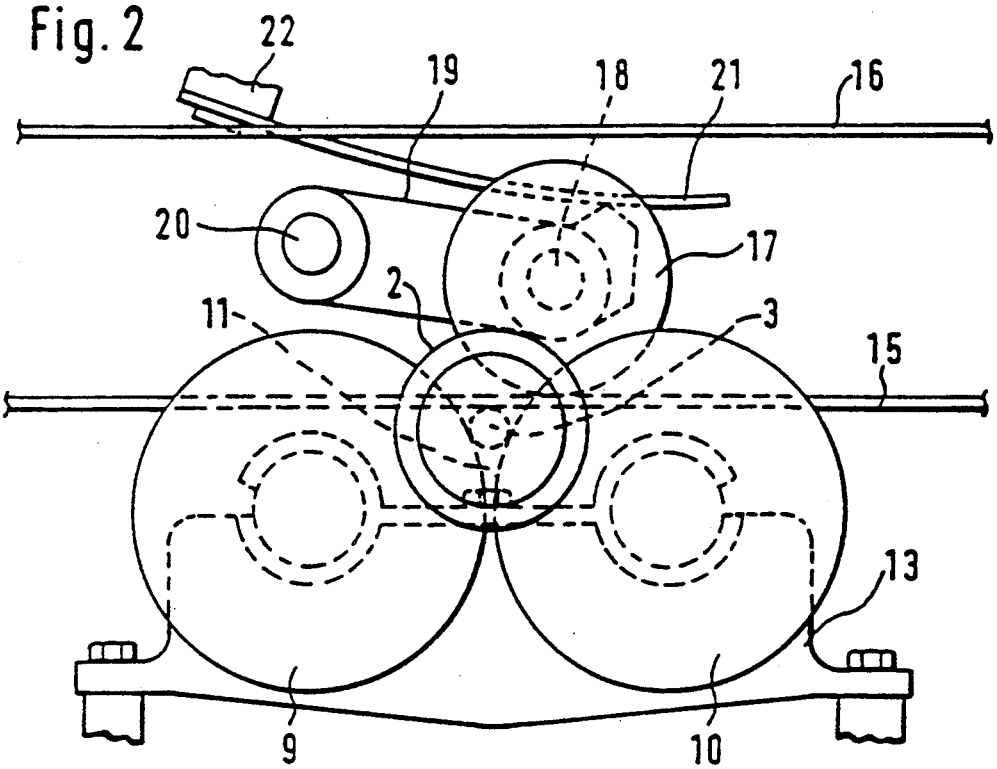
FIG. 2 is a view in the direction of the arrow II of the embodiment according to FIG. 1, several components having been left out for the purpose of the clarity of the representation.

The rotor 2, which is represented in FIGS. 3 to 5 in an enlarged sectional view has a fiber collecting groove 35 on the inside in the area of its largest diameter in front of which groove a sliding surface 36 is connected which widens conically in the direction of the fiber collecting groove 35 and starts at the open end 37 of the rotor 2. The fibers to be spun, by means of a component which is not shown and which has an insert which projects into the rotor 2 during the operation, are fed to the sliding wall 36 on which they then slide into the fiber collecting groove 35 from which the collected fibers are withdrawn as a spun yarn which receives a twist. The withdrawal takes place through a yarn withdrawal nozzle arranged coaxially to the rotor 2. For a perfect spinning operation, it is necessary that the relative position of the rotor 2 with respect to the insert which is not shown is predetermined as precisely as possible; that is, particularly the position of the withdrawal nozzle with respect to the fiber collecting groove 35 and the position of the mouth of the fiber feeding duct with respect to the yarn withdrawal groove 35, but also to the open end 37 of the rotor 2. The axial position of the rotor 2, as explained by means of FIGS. 1 and 2, is determined by the adjustable abutment 25, in which case, a total length (a) between the open end 37 of the rotor 2 and the step bearing surface 32 in the case of a new spinning rotor (FIG. 3) is used as the basis. This also defines the position of the fiber collecting groove 35 which is provided with high precision at a point disposed toward the open end 37 of the rotor 2.

It was found that nowadays, even after a long operating period, the rotor 2 is subject to virtually no wear. It is manufactured of a special steel alloy and subsequently, particularly the interior surfaces, that is, the sliding wall 36 and the fiber collecting groove 35, were subjected to a surface treatment and a subsequent coating. It was found that, in the case of an open-end spinning rotor of this type, after an extensive operating period, wearing occurs in the area of the step bearing surface 32 which has the result that the rotor 2 will then no longer take up its desired axial position. This wearing in the area of the step bearing surface 32 which results in a shortened overall length (a1), as shown in FIG. 4, has the result that then the previously adjusted spinning condition will no longer exist. By a shortening of the rotor shaft 3 in the area of the step bearing surface 32 which, in FIGS. 3 to 5, was placed in the plane (Y), the rotor 2 will then shift its position by a distance (d) with respect to the parts cooperating with it, in which case, in FIGS. 3 to 5, the desired plane is marked by an X.

By means of its end area 40 facing the rotor 2, the rotor shaft 3 is pressed into a bore 33 of a hub 39 of the rotor 2. The hub 39 determines a press fit of an axial length (c). In order to compensate the change of length (d), it is provided that the rotor shaft 3 is shifted in the bore 33 of the hub 39, that is, is pulled out or pushed out in the direction of the step bearing surface 32. As a result, an overall length (a) will then be obtained again between the step bearing surface 32 and the open end 37 of the rotor 2 and thus also between the step bearing surface 32 and the fiber collecting groove 35 which corresponds to the new condition (FIG. 3) of the open-end spinning rotor, as shown in FIG. 5.

Since irregular or uneven wearing phenomena occur during the wearing of the step bearing surface 32, it is also provided that the step bearing surface is refinished by machining, particularly regrinding in certain preferred embodiments of the invention. By means of this refinishing, a new step bearing surface 32 is produced which represents a plane surface disposed in a radial plane. Since, in the case of this refinishing, the rotor shaft 3 is shortened again in the area of its end 23 from the worn-off length ($b_1$) to the refinished length ($b_2$), this change of length must also be taken into account during the axial shifting of the rotor shaft 3 in the hub 39. The approach is that either the rotor shaft 3 is first pushed beyond the measurement required for the restoring of the desired length (a) and subsequently is ground back to length (a).

In another solution contemplated by the present invention, it is provided that the step bearing surface 32 is first reground on the shortened open-end spinning rotor 1, as it is shown in FIG. 4, and that subsequently first the rotor shaft 3 is shifted in the hub 39 in such a manner that the length (a) is obtained again which corresponds to the new condition.

As a rule, the axial length (c) of the press fit is sufficient for permitting at least a one-time refinishing since, as a rule, it is overdimensioned. In order to permit a repeated restoring of the operability of the open-end spinning rotor 1, it is provided in the embodiment shown in FIGS. 3 to 5 that the end 38 of the rotor shaft 3, during the renewal, projects over the rotor bottom 34 by a predetermined measurement (e). This measurement (e), whose size is exaggerated in the drawing, is selected such that the front end 38 is situated at a sufficient distance from the plane of the fiber collecting groove 35 so that the spinning operation is not impaired. As a result, it becomes possible to restore the operability of the open-end spinning rotor 1 without changing the effective length (c) of the press fit between the end area 40 of the rotor shaft 3 and the hub 39 during an axial shifting. The projecting of the front end 38 of the rotor shaft 3 by the measurement (e), in this case, is shortened to the measurement ($e_1$).

It should be pointed out that the measurements (d, e, b) are shown in exaggerated sizes in the drawings of FIGS. 3 to 5 for reasons of clarity. The measurement (e)

of the axial projection 38 in this case may easily be selected according to the invention such that a repeated refinishing is possible for restoring the operation of the open-end spinning rotor 1.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A method for preventing the inoperatability of an open-end spinning rotor assembly which has a rotor with a fiber collecting groove and a hub into which a front end of a rotor shaft is pressed, the opposite free rear end of the rotor shaft exhibiting a step bearing surface which is arranged at a predetermined distance to the fiber collecting groove, said method comprising restoring the distance between the fiber collecting groove and the step bearing surface to a predetermined distance after the wearing-out of the step bearing surface by axial shifting of the rotor shaft front end in the hub of the rotor.

2. A method according to claim 1, comprising refinishing the step bearing surface before the shaft is axially shifted in the hub of the rotor.

3. A method according to claim 2, comprising regrinding the step bearing surface as part of said restoring of the distance between the fiber collecting groove and the step bearing surface.

4. A method according to claim 3, wherein said regrinding includes regrinding the step bearing surface to a plane radial surface.

5. A method according to claim 1, comprising refinishing the step bearing surface after the axial shifting of the shaft in the hub of the rotor, during which a larger distance is generated than the predetermined distance between the step bearing surface and the fiber collecting groove.

6. A method according to claim 5, comprising regrinding the step bearing surface as part of said restoring of the distance between the fiber collecting groove and the step bearing surface.

7. A method according to claim 6, wherein said regrinding includes regrinding the step bearing surface to a plane radial surface.

8. A method according to claim 7, wherein, when the open-end spinning rotor is in a first predetermined condition, the front end of the rotor shaft facing away from the step bearing surface projects over the hub in the axial direction into an interior of the rotor.

9. A method according to claim 5, wherein, when the open-end spinning rotor is in a first predetermined condition, the front end of the rotor shaft facing away from the step bearing surface projects over the hub in the axial direction into an interior of the rotor.

10. A method according to claim 1, wherein, when the open-end spinning rotor is in a first predetermined condition, the front end of the rotor shaft facing away from the step bearing surface projects over the hub in the axial direction into an interior of the rotor.

11. Open-end spinning apparatus comprising:

a spinning rotor shaft with a front end supporting said spinning rotor, and a step bearing supporting the rear end of the spinning rotor shaft opposite the spinning rotor with the fiber collecting groove a predetermined distance from the step bearing rear end of the spinning rotor shaft, said spinning rotor including a rotor hub with an opening for accommodating the front end of the spinning rotor shaft, wherein said rotor shaft is disposed in the hub to be axially displaceable relative to the hub to accommodate restoration of said predetermined distance after wearing of the step bearing rear end of the rotor shaft.

12. A method according to claim 11, wherein, when the open-end spinning rotor is in a first predetermined condition, the front end of the rotor shaft facing away from the step bearing surface projects over the hub in the axial direction into an interior of the rotor.

* * * * *